US006064043A

United States Patent [19]

Livers, Jr. et al.

[11] Patent Number: 6,064,043

[45] Date of Patent: May 16, 2000

[54] DRYER CONTROL CIRCUIT

[75] Inventors: James D. Livers, Jr., Cookeville; John D. Cox, Gallatin, both of Tenn.

[73] Assignee: France/Scott Fetzer Company, Fairview, Tenn.

[21] Appl. No.: 09/323,354

[22] Filed: Jun. 1, 1999

[51] Int. Cl.[7] ..... H05B 1/02; E26B 17/24

[52] U.S. Cl. ..... 219/492; 34/53

[58] Field of Search ..... 219/492, 491, 219/493, 494, 364, 511, 501; 34/53, 45, 48, 54

[56] References Cited

U.S. PATENT DOCUMENTS

| | | | |
|---|---|---|---|
| 2,645,032 | 7/1953 | Hammell . | |
| 2,838,845 | 6/1958 | Erickson . | |
| 2,863,224 | 12/1958 | Zehrbach . | |
| 3,132,004 | 5/1964 | Horecky . | |
| 3,302,299 | 2/1967 | Scherzinger . | |
| 3,510,957 | 5/1970 | Jarvis . | |
| 3,609,873 | 10/1971 | Odle, Jr. et al. . | |
| 3,942,265 | 3/1976 | Sisler et al. . | |
| 4,083,118 | 4/1978 | Cotton . | |
| 4,112,588 | 9/1978 | Marcade | 34/527 |
| 4,132,008 | 1/1979 | Deschaaf . | |
| 4,225,812 | 9/1980 | Kraus . | |
| 4,231,166 | 11/1980 | McMillan | 34/553 |
| 4,642,907 | 2/1987 | Best . | |
| 4,698,767 | 10/1987 | Wensel et al. | 77/3 |
| 4,842,192 | 6/1989 | Range et al. | 236/68 B |
| 4,868,997 | 9/1989 | Smock et al. . | |

*Primary Examiner*—Teresa Walberg
*Assistant Examiner*—Jeffrey C. Pwu
*Attorney, Agent, or Firm*—Wood, Herron & Evans, L.L.P.

[57] ABSTRACT

A dryer timing control circuit includes a heater rated to operate at 240 volts and having one side connected to power. A thermostatic switch is connected between power and the other side of the heater. The thermostatic switch closes in response to a lower temperature in the dryer and opens in response to a higher temperature in the dryer. A timer motor rated to operate at approximately 240 volts has a first input connected to power. A timer motor switch operable by the timer motor has a first switch state connecting the timer motor to the heater without an intervening voltage dropping resistor. The timer motor operates in response to the timer motor switch being in the first state and the thermostatic switch being open, thereby applying 240 volts across the timer motor. The timer motor operation is terminated in response to the timer motor switch being in the first state and the thermostatic switch being in the closed state. In a second state, the timer motor switch connects the timer motor directly to 240 volts. In another embodiment, the timer motor is rated to operate at both 120 volts and 240 volts The timer motor switch in its first state operates the timer motor at 240 volts as described above, however, in its second state, the timer motor switch connects the timer motor directly to 120 volts.

18 Claims, 1 Drawing Sheet

DRYER CONTROL CIRCUIT

FIELD OF THE INVENTION

This invention relates generally to the field of appliance control circuits and, more particularly, to an improved dryer control circuit.

BACKGROUND OF THE INVENTION

Timer control circuits for automatically controlling a cycle of operation of a laundry dryer have been utilized for almost 50 years. There has been continuing efforts over that period of time to make such control circuits simpler, more reliable and less expensive, all to the benefit of the consumer. One problem arises in such control circuits in that during an automatic drying cycle, an exhaust air thermostat is used to operate both a cycle timer motor and a dryer heater. However, normally the dryer heater operates at 240 volts ("v"), whereas the cycle timer motor operates at 120 v. One solution is to use a two pole thermostat so that the cycle timer motor and heater can be simultaneous but independently switched with two different sets of contacts operated by the thermostat. Such two pole thermostats are relatively expensive, and therefore, many dryers employ a simpler circuit as illustrated in U.S. Pat. Nos. 4,868,997; 4,642,907; 4,132,008 and 3,942,265.

Referring to FIG. 1, of U.S. Pat. No. 4,868,997, during the automatic drying cycle, timer switch 22 is open; and the timer motor 16 is connected to a dropping resistor 25 which in turn is connected to a heater 11. At the beginning of the cycle, the contacts of thermostat 12 are closed, thereby connecting the heater 11 to power line L1. Opening the contacts of thermostat 12 removes the shunt from around the timer motor 16; and current then flows through the timer motor 16, the resistor 25 and the heater 11 between the 240 volt power terminals L1, L2. The resistor 11 and the resistance of the timer motor are sized so that approximately 120 v is dropped across the resistor 11, and 120 v is applied to the timer motor 16, thereby turning the timer motor 16 ON. The resistance of the heater 11 is very small and therefore only a minimal voltage drop exists across the heater 11; and current flow through the circuit comprised of the timer motor 16, the resistor 25 and the heater 11 is so small as to make the heater 11 essentially inoperable.

The use of the voltage dropping resistor 11 has several disadvantages. First, the dropping resistor 11 adds cost to the circuit. Further, the resistor 11 is normally in the range of from 5–10 watts and may require a special mounting and/or a heat sink. In addition, during the manufacturing process, there is always the possibility that the dropping resistor could be omitted which may result in either an inoperative timer motor during the automatic drying cycle or worse, a burned out timer motor. Therefore, in an effort to continually seek to improve circuit performance, reliability and economy, there is a need to provide a dryer control circuit that does not require and have the disadvantages of a control circuit employing a voltage dropping resistor.

SUMMARY OF THE INVENTION

The present invention provides an improved timer control circuit that permits the timer motor and heater to be directly connected in a 240 volt series circuit without an intervening voltage dropping resistor. Thus, the present invention has the advantages of providing a dryer timer control circuit that operates more reliably, with fewer parts and at less cost. The dryer control circuit of the present invention is also more easily and reliably assembled and manufactured.

In accordance with the principles of the present invention and in accordance with the described embodiments, the present invention provides a dryer timing control circuit operable with first and second power wires having a first voltage potential therebetween. The dryer timing control circuit includes a heater rated to operate at the voltage potential and having a first input connected to the first power wire. A thermostatic switch is connected between the second power wire and a second input of the heater. The thermostatic switch closes in response to a lower temperature in the dryer and opens in response to a higher temperature in the dryer. A timer motor rated to operate at the first voltage potential has a first input connected to the second power wire. A timer motor switch is operable by the timer motor and in a first switch state connects the timer motor to the heater without an intervening voltage dropping resistor. The timer motor operates in response to the timer motor switch being in the first state and the thermostatic switch being open, thereby applying the first voltage potential across the timer motor. The timer motor operation is terminated in response to the timer motor switch being in the first state and the thermostatic switch being in the closed state.

In one aspect of the invention, the timer motor switch has a second state connecting the timer motor to the first power wire, thereby applying the first voltage potential across the timing motor independent of the state of the thermostatic switch.

In a second embodiment of the invention, heater and thermostatic switch operate as indicated above; however, the timer motor is rated to operate at both the first voltage potential and a second, lower voltage potential. The timer motor switch operates in the first state as described above to periodically connect the timer motor to the first voltage potential as a function of the operation of the thermostatic switch. However, in this embodiment, the timer motor switch has a contact connected to a neutral power line; and therefore, the second state of the timer motor switch connects the timer motor to the neutral, thereby operating the timer motor at the second, lower voltage potential.

These and other objects and advantages of the present invention will become more readily apparent during the following detailed description together with the drawings herein.

DETAILED DESCRIPTION OF THE INVENTION

Figure 1:
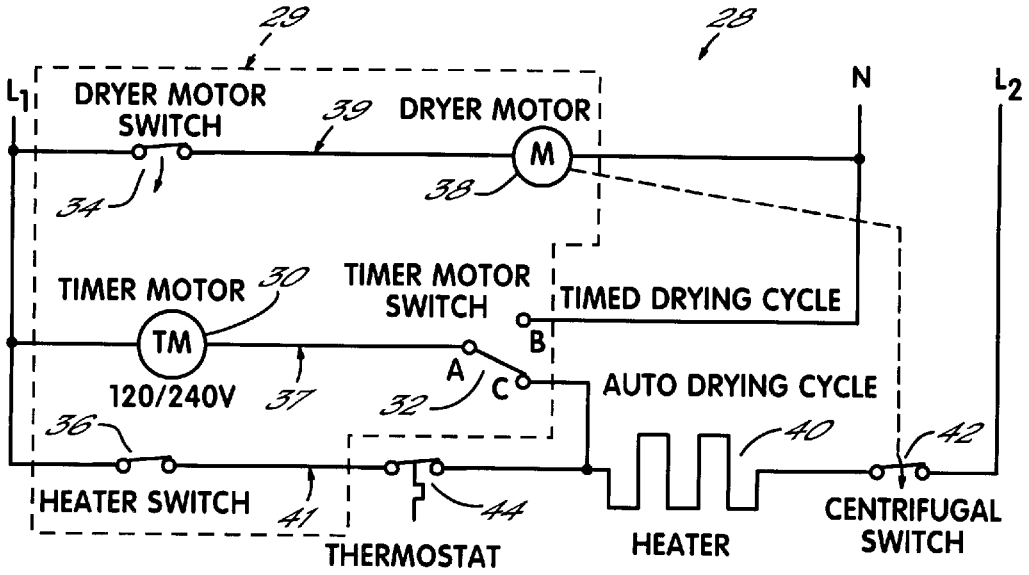
FIG. 1 is a schematic circuit diagram of a first embodiment of a dryer control circuit in accordance with the principles of the present invention.

Referring to FIG. 1, a dryer control circuit 28 is supplied with a known three wire 240 volt ("v") power supply, wherein a 240 v potential exists across wires L1 and L2, and a 120 v potential exists between either one of the wires L1 and L2 and a neutral wire N. A dryer timer 29 normally consists of a timer motor 30 that is connected through a gear drive (not shown) to one or more cams (not shown). Each of the cams is associated with one or more timer switches that are switched between closed and open states as the timer motor 30 rotates the cams through a single revolution. In FIG. 1, the switches within the timer 29 are a timer motor switch 32, a dryer motor switch 34 and a heater switch 36.

The cams are also, in a known manner, mechanically coupled to a knob (not shown) by which the user can select a desired initial state or cycle of operation.

In a first circuit leg 37 within FIG. 1, the timer motor 30 has one input connected to power wire L1 and another input connected to a common contact A of the timer motor switch 32. Another contact B of the timer motor switch 32 is connected to the neutral N, so that, when contacts A and B are closed, 120 v is applied to the timer motor 30. Unlike the 120 v timer motors in known dryer control circuits, the timer motor 30 is a dual voltage motor, that is, it is manufactured to run on either 120 v or 240 v.

In a second circuit leg 39, a dryer motor switch 34 has one contact connected to power wire L1 and another contact connected to an input of a 120 v dryer motor 38. The other input of the dryer motor 38 is connected to the neutral wire N.

In another circuit leg 41, the thermostat 44 has one contact in electrical communication with the power wire L1 via the heater switch 36, and the other contact of the thermostat 44 is connected to a first input or lead of the heater 40, for example a 5,000 watt heater. The heater 40 has another input or lead in electrical communication with the power wire L2 via the centrifugal switch 42, thereby placing the heater 40 in a series circuit with the centrifugal switch 42. In addition, the other input of the timer motor 30 is electrically connected through the contacts A and C of timer motor switch 30 directly to the first input of the heater 40 without an intervening voltage dropping resistor. Since the timer motor 30 can operate on either 120 v or 240 v, an intervening voltage dropping resistor is not required. Known design criteria may be used to determine the wire sizes and number of windings to be used in the stator and/or rotor of the timer motor 30 to provide the desired 120 v/240 v dual voltage operation.

In use, if the user turns the knob on the timer 29 to select a timed cycle without heat, the cams within the timer 29 are moved to an initial position such that contacts A and B of the timer motor switch 32 are closed, thereby applying 120 v across the timer motor 30 and turning timer motor 30 on. Further, the contacts of the dryer motor switch 34 in the timer 29 are closed to connect a 120 v dryer motor 38 between line L1 and neutral to turn on the dryer motor 38. The contacts in the heater switch 36 in the timer 29 are open, so that heater 40 cannot be turned on. The dryer motor 38 and timer motor 30 continue to run until the timer motor 30 rotates to a point where a cam opens contacts A and B of the timer motor switch 32 and the contacts of the dryer motor switch 34, thereby terminating the operation of the respective timer motor 30 and dryer motor 38.

If a timed cycle with heat is selected by the user, the cams of the timer 29 are moved to an initial position such that, as before, the contacts A and B of the timer motor switch 32 are closed; and the dryer motor switch 34 is closed initiate the operation of both the timer motor 30 and the dryer motor 38. As the dryer motor 38 turns on, a centrifugal switch 42 detects the rotation of the dryer motor 38; and the contacts of the centrifugal switch 42 close. In addition, the contacts in the heater switch 36 in the timer are closed, and the contacts in the thermostat 44 are normally closed, thereby applying 240 v across the heater 40 and turning the heater 40 on. The thermostat 44 is normally located so that it detects the temperature of the air being exhausted from the dryer. During the timed drying cycle, the timing motor 30 runs continuously; but the heater 40 is turned on and off as the temperature being measured by the thermostat 44 is respectively below and above the set point temperature of the thermostat 44. Again, the dryer motor 38 continues to run until the timer motor 30 rotates to a point where a cam opens contacts A and B of the timer motor switch 32 as well as the contacts in both the dryer motor switch 34 and the heater switch 36, thereby terminating the operation of the timer motor 30, dryer motor 38 and the heater 40, respectively. As the dryer motor 38 comes to a stop, the contacts within the centrifugal switch 42 also open.

If an automatic drying cycle is selected by the user, the cams of the timer 29 are moved to an initial position such that contacts A and C of the timer motor switch 32 are closed. The timer motor 30 is then connected directly to one input of the heater 40 without an intervening dropping resistor, thereby placing the timer motor 30 in a series circuit with the centrifugal switch 42. Further, the dryer motor switch 34 is closed to initiate the operation of the dryer motor 38, and the heater switch 36 is closed.

The operation of the heater 40 and timer motor 30 in the automatic drying cycle is controlled by the thermostat 44. At the beginning of the cycle, the contacts in the thermostat 44 are closed, thereby connecting the heater 40 to power line L1. The centrifugal switch 42 is closed by the rotation of the dryer motor 38, thereby connecting the heater 40 to power line L2 and applying 240 volts to the heater 40. With the heater turned ON, the thermostat 44 provides a shunt around the timer motor 30; and the timer motor 30 is maintained inoperative. In a known manner, hot air from the heater 40 is blown onto the clothes tumbling in the drum of the dryer. During the early stages of the drying cycle, most of the heat is absorbed by the moisture in the tumbling clothes; and the temperature of exhaust air from the dryer remains below the switching point of the thermostat 44.

After a period of time, some of the moisture in the tumbling clothes evaporates; and the temperature of the exhaust air rises to the point that the contacts of the thermostat 44 open. Opening the thermostat 44 removes the shunt from around the timer motor 30; and current then flows through the timer motor 30, and the heater 40 between the 240 volt power terminals L1, L2, thereby turning the timer motor ON. The resistance of the heater is so small as to make the heater essentially inoperable.

The remaining moisture in the clothes continues to absorb the residual heat in the dryer drum, and the temperature of the exhaust air from the dryer drops, thereby causing the contacts in the thermostat 44 to again close. Closing the thermostat 44 shunts the timer motor 30, thereby turning the timer motor 30 OFF and again turning the heater 40 ON. That cycle continues until all of the moisture has evaporated from the clothes, and the thermostat 44 remains open until the timer motor 30 rotates to a point where a cam opens both the heater switch 36 and the dryer motor switch 34 within the timer. As the dryer motor 38 stops, the centrifugal switch 42 opens, thereby interrupting the supply of power to the timer motor 30 and it also stops.

Figure 2:
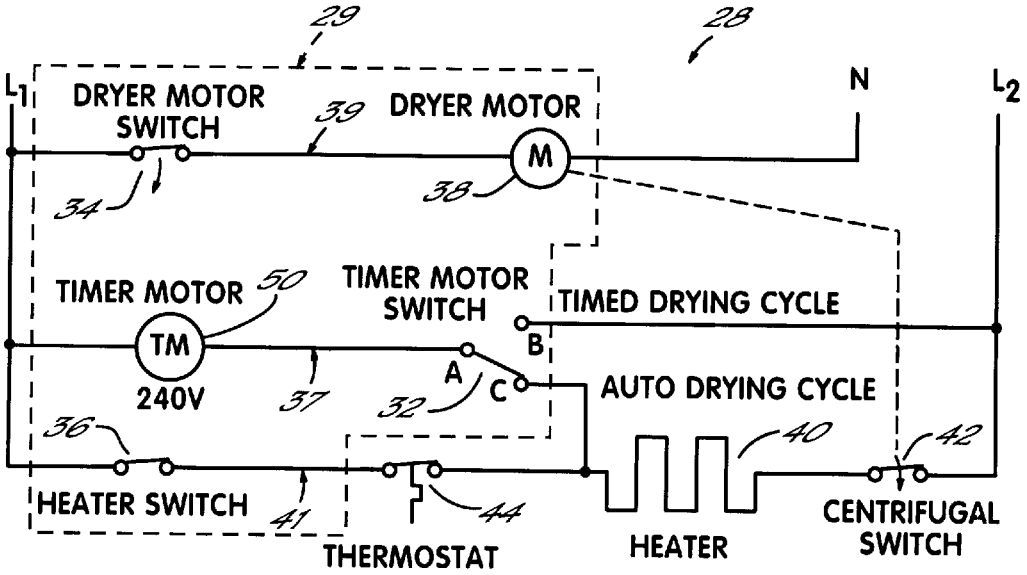
FIG. 2 is a schematic circuit diagram of a second embodiment of a dryer control circuit in accordance with the principles of the present invention.

Another embodiment of the invention is illustrated in FIG. 2. All of the circuit elements of FIG. 2 are identical to the circuit elements of FIG. 1 except that, in FIG. 2, a timer motor 50 is manufactured to run on only 240 v. In this embodiment, the contact B of the timer motor switch 32 is connected to the power wire L2. The operation of the timer control circuit of FIG. 2 is almost identical to the operation of the timer control circuit of FIG. 1 previously described. The only difference is that in FIG. 2, when a timed drying cycle is selected by the user and contacts A and B of the timer motor switch 32 are closed, 240 v are applied to the timer motor 50. Known design criteria may be used to determine the wire sizes and number of windings to be used in the stator and/or rotor of the timer motor 30 to provide the desired 240 v operation.

While the invention has been set forth by a description of the preferred embodiment in considerable detail, it is not intended to restrict or in any way limit the claims to such detail. Additional advantages and modifications will readily appear to those who are skilled in the art. For example, it should be noted that FIGS. 1 and 2 do not represent the totality of a dryer control circuit. Dryer control circuits may included other features, for example, a dryer door interlock switch, an over-temperature thermostat, etc., which are not illustrated and not necessary to the explanation of the present invention. Further, dryer cycle timers may include other cycles of operation that are not described and not considered necessary to the explanation of the present invention. In addition, it should be noted that the wiring of the components in the dryer control circuit of FIGS. 1 and 2 may be changed without changing the operation of the circuit. For example, the arrangement of the heater switch 36 and the thermostat 44 may be interchanged, and the circuit will operate identically. Similarly, the operation of the control circuit 28 is not affected by either interchanging the centrifugal switch 42 with the heater 40 or, interchanging the dryer motor switch 34 with the dryer motor 38.

Therefore, the invention in its broadest aspects is not limited to the specific detail shown and described. Consequently, departures may be made from the details described herein without departing from the spirit and scope of the claims which follow.

What is claimed is:

1. A dryer timing control circuit operable with first and second power wires having a voltage potential therebetween, the dryer timing control circuit comprising:

a heater rated to operate at approximately the voltage potential and having a first input in electrical communication with the first power wire and a second input;

a first switch having a first contact in electrical communication with the second power wire and a second contact in electrical communication with the second input of the heater, the first switch having a first state placing the first and second contacts of the first switch in electrical communication in response to a first temperature within the dryer, and the first switch having a second state interrupting the electrical communication between the first and second contacts of the first switch in response to a second temperature within the dryer;

a timer motor rated to operate at approximately the voltage potential, the timer motor having a first input in electrical communication with the second power wire and a second input; and a second switch operable by the timer motor to provide a first state placing the second input of the timer motor in electrical communication with the second input of the heater without an intervening voltage dropping resistor, the timer motor operating in response to the second switch being in the first state and the first switch being in the second state to apply the voltage potential across the timer motor, and the timer motor operation being terminated in response to the second switch being in the first state and the first switch being in the first state.

2. A dryer timing control circuit of claim 1 wherein the second switch has a second state electrically connecting the second input of the timer motor to the first power wire and operating the timer motor with the voltage potential.

3. A dryer timing control circuit of claim 1 wherein the first switch is a thermostat, the first and second contacts close in response to the first temperature being below a thermostat set point temperature and the first and second contacts open in response to the second temperature being above the thermostat set point temperature.

4. A dryer timing control circuit 1 further comprising a centrifugal switch having a first contact in electrical communication with the first input of the heater and a second contact connected to the first power wire.

5. A dryer timing control circuit of claim 1 wherein the voltage potential is approximately 240 volts.

6. A dryer timing control circuit operable with first and second power wires having a voltage potential therebetween, the dryer timing control circuit comprising:

a heater rated to operate at approximately the voltage potential and having a first lead in electrical communication with the first power wire and a second lead;

a first switch having a first contact in electrical communication with the second power wire and a second contact, the first switch having a first state placing the first and second contacts in electrical communication in response to a first temperature within the dryer, and the first switch having a second state interrupting the electrical communication between the first and second contacts in response to a second temperature within the dryer; and a timer motor rated to operate at approximately the voltage potential, the timer motor having a first input in electrical communication with the second power wire and a second input, a second switch operable by the timer motor and having a common contact in electrical communication with the second input of the timer motor, a first contact in electrical communication with the second lead of the heater without an intervening voltage dropping resistor, a second contact in electrical communication with the first power wire, and the second switch being selectively operable between a first state electrically connecting the common contact with the first contact of the second switch and a second state electrically connecting the common contact with the second contact of the second switch;

the timer motor operating in response to the first state of the second switch and the second state of the first switch, and the timer motor operation being terminated in response to the first state of the second switch and the first state of the first switch.

7. A dryer timing control circuit of claim 6 wherein the second state of the second switch electrically connects the second input of the timer motor to the first power wire, thereby operating the timer motor at the voltage potential.

8. A dryer timing control circuit of claim 6 further comprising a centrifugal switch having a first contact in electrical communication with the first input of the heater and a second contact connected to the first power wire.

9. A dryer timing control circuit operable with first and second power wires having a voltage potential therebetween, the dryer timing control circuit comprising:

a timer motor switch having a common contact, a first contact, a second contact connected to the first power wire, and the timer motor switch being operable to selectively connect the common contact with the first contact to define a first switch state and the common contact with the second contact to define a second switch state;

a heater rated to operate at the voltage potential;

a centrifugal switch in a series circuit with the heater, the centrifugal switch closing in response to an operating state of the dryer and opening in response to an absence of the operating state of the dryer, and the series circuit having one lead therefrom connected to the first power wire and a second lead therefrom connected to the second contact of the switch;

a thermostatic switch connected between the second power wire and the second lead of the series circuit, the thermostatic switch having a closed state connecting the second power wire with the second lead of the series circuit in response to a first, lower temperature within the dryer, and the thermostatic switch having an open state disconnecting the second power wire and the second lead of the series circuit in response to a second, higher temperature within the dryer; and a timer motor rated to operate at the voltage potential and in mechanical communication with the timer motor switch to operate the timer motor switch, the timer motor having a first lead connected to the common contact of the timer motor switch and a second lead connected to the second power wire, the timer motor operating first, in response to the second state of the timer motor switch and second, in response to the first state of the timer motor switch, the closed centrifugal switch and the open state of the thermostatic switch, and the timer motor operation being terminated in response to the first state of the timer motor switch and the closed state of the thermostatic switch.

10. A dryer timing control circuit of claim 9 wherein the voltage potential is approximately 240 volts.

11. A dryer timing control circuit operable with first and second power wires having a first, larger voltage potential therebetween and a neutral wire having a second, smaller voltage potential between the neutral wire and either one of the first and second power wires, the dryer timing control circuit comprising:

a heater rated to operate at approximately the first voltage potential and having a first input in electrical communication with the first power wire and a second input;

a first switch having a first contact in electrical communication with the second power wire and a second contact in electrical communication with the second input of the heater, the first switch having a first state placing the first and second contacts of the first switch in electrical communication in response to a first temperature within the dryer, and the first switch having a second state interrupting the electrical communication between the first and second contacts of the first switch in response to a second temperature within the dryer;

a timer motor rated to operate at both of the first and second voltage potentials, the timer motor having a first input in electrical communication with the second power wire and a second input; and a second switch operable by the timer motor to provide a first state placing the second input of the timer motor in electrical communication with the second input of the heater without an intervening voltage dropping resistor, a second state electrically connecting the second input of the timer motor to the neutral wire, and the timer motor operating in response to the second switch being in the first state and the first switch being in the second state, thereby applying the first, larger voltage potential to the timer motor, and the second switch being in the second state, thereby applying second, smaller voltage potential to the timer motor, and the timer motor operation being terminated in response to the second switch being in the first state and the first switch being in the first state.

12. A dryer timing control circuit of claim 11 wherein the first switch is a thermostat, the first and second contacts close in response to the first temperature being below a thermostat set point temperature and the first and second contacts open in response to the second temperature being above the thermostat set point temperature.

13. A dryer timing control circuit 11 further comprising a centrifugal switch having a first contact in electrical communication with the first input of the heater and a second contact connected to the first power wire.

14. A dryer timing control circuit 11 wherein the first, higher voltage potential is approximately 240 volts and the second, smaller voltage potential is approximately 120 volts.

15. A dryer timing control circuit operable with first and second power wires having a first, higher potential therebetween and a neutral wire having a second smaller voltage potential between the neutral wire and either one of the first and second power wires, the dryer timing control circuit comprising:

a heater rated to operate at approximately the first, higher voltage potential and having a first lead in electrical communication with the first power wire and a second lead;

a first switch having a first contact in electrical communication with the second power wire and a second contact, the first switch having a first state placing the first and second contacts in electrical communication in response to a first temperature within the dryer, and the first switch having a second state interrupting the electrical communication between the first and second contacts in response to a second temperature within the dryer; and a timer motor rated to operate at approximately the second, smaller voltage potential, the timer motor having a first input in electrical communication with the second power wire and a second input, a second switch operable by the timer motor and having a common contact in electrical communication with the second input of the timer motor, a first contact in electrical communication with the second lead of the heater without an intervening voltage dropping resistor, a second contact in electrical communication with the neutral wire, and the second switch being selectively operable between a first state electrically connecting the common contact with the first contact of the second switch and a second state electrically connecting the common contact with the second contact of the second switch;

the timer motor operating in response to the second switch being in the first state and the first switch being in the second state, thereby applying the first, higher voltage potential to the timer motor, and the second switch being in the second state, thereby applying the second, smaller voltage potential to the timer motor, and the timer motor operation being terminated in response to the second switch being in the first state and the first switch being in the first state.

16. A dryer timing control circuit 15 further comprising a centrifugal switch having a first contact in electrical communication with the first input of the heater and a second contact connected to the first power wire.

17. A dryer timing control circuit operable with first and second power wires having a first, higher potential therebetween and a neutral wire having a second, lower voltage potential between the neutral wire and one of the first and second power wires, the dryer timing control circuit comprising:

a timer motor switch having
- a common contact,
- a first contact,
- a second contact connected to the neutral wire, and
- the timer motor switch being operable to selectively connect the common contact with the first contact to define a first switch state and the common contact with the second contact to define a second switch state;

a heater rated to operate at the first, higher voltage potential;

a centrifugal switch in a series circuit with the heater, the centrifugal switch closing in response to an operating state of the dryer and opening in response to an absence of the operating state of the dryer, and the series circuit having one lead therefrom connected to the first power wire and a second lead therefrom connected to the second contact of the switch;

a thermostatic switch connected between the second power wire and the second lead of the series circuit, the thermostatic switch having a closed state connecting the second power wire with the second lead of the series circuit in response to a first, lower temperature within the dryer, and the thermostatic switch having an open state disconnecting the second power wire and the second lead of the series circuit in response to a second, higher temperature within the dryer; and a timer motor rated to operate at both the first, higher voltage potential and the second, lower voltage potential and in mechanical communication with the timer motor switch to operate the timer motor switch, the timer motor having a first lead connected to the common contact of the timer motor switch and a second lead connected to the second power wire, the timer motor operating in response to
- the timer motor switch being in the first state and the thermostatic switch being in the open state, thereby applying the first, higher voltage potential to the timer motor, and
- the timer motor switch being in the second state, thereby applying the second, lower voltage potential to the timer motor, and the timer motor operation being terminated in response to the timer motor switch being in the first state and the thermostatic switch being in the closed state.

18. A dryer timing control circuit 17 wherein the first, higher voltage potential is approximately 240 volts and the second, smaller voltage potential is approximately 120 volts.

* * * * *